United States Patent [19]

Cheung

[11] Patent Number: 4,568,528

[45] Date of Patent: Feb. 4, 1986

[54] PROCESS TO PRODUCE A KRYPTON-XENON CONCENTRATE AND A GASEOUS OXYGEN PRODUCT

[75] Inventor: Harry Cheung, Buffalo, N.Y.

[73] Assignee: Union Carbide Corporation, Danbury, Conn.

[21] Appl. No.: 641,280

[22] Filed: Aug. 16, 1984

[51] Int. Cl.[4] ..... C01B 23/00

[52] U.S. Cl. ..... 423/262; 62/22; 55/66

[58] Field of Search ..... 423/262; 62/22; 55/66

[56] References Cited

U.S. PATENT DOCUMENTS

| | | | |
|---|---|---|---|
| 3,191,393 | 6/1965 | Dennis | 62/22 |
| 3,596,471 | 8/1971 | Streich | 62/22 |
| 3,609,983 | 10/1971 | Lofredo et al. | 62/22 |
| 3,751,934 | 8/1973 | Frischbier | 62/41 |
| 3,768,270 | 10/1973 | Schuftan | 62/31 |
| 3,779,028 | 12/1973 | Schuftan et al. | 62/22 |
| 4,384,876 | 5/1983 | Mori et al. | 62/22 |
| 4,401,448 | 8/1983 | LaClair | 62/22 |
| 4,421,536 | 12/1983 | Mori et al. | 62/18 |

*Primary Examiner*—John Doll
*Assistant Examiner*—Jackson Leeds
*Attorney, Agent, or Firm*—Stanley Ktorides

[57] ABSTRACT

A krypton-xenon concentration process which also produces substantially rare gas-free oxygen gas while requiring a stripping column substantially smaller than is required by conventional process wherein feed liquid is provided directly to a reboiling zone and only the vapor from the reboiling zone is passed through the stripping column.

18 Claims, 1 Drawing Figure

PROCESS TO PRODUCE A KRYPTON-XENON CONCENTRATE AND A GASEOUS OXYGEN PRODUCT

TECHNICAL FIELD

This invention relates to the production of a krypton-xenon concentrate and is an improvement whereby the krypton-xenon concentrate is produced at high efficiency and a gaseous oxygen product substantially free of rare gases is also produced.

BACKGROUND ART

Krypton and xenon are undergoing increasing demand in a number of applications. Krypton is being widely used in high quality lighting including long-life light bulbs and automotive lamps. Xenon is being used for medical applications including special x-ray equipment. Both of these gases are commonly used in many laboratory and research applications.

The principle source of krypton and xenon is the atmosphere. Atmospheric air contains about 1.1 ppm (parts per million) of krypton and about 0.08 ppm of xenon. Generally, krypton and xenon are recovered from the air in conjunction with a comprehensive air separation process which separates air into oxygen and nitrogen.

Due to the lower vapor pressure of krypton and xenon, these gases concentrate in the oxygen rather than in the nitrogen during the air separation. The concentration of the atmospheric krypton and xenon in the oxygen increases their concentration by a factor of five because oxygen comprises only about one-fifth of the atmospheric air. It is desirable to further concentrate the krypton and xenon so that they may be effectively recovered in a rare gas recovery facility.

Generally one wishes to produce gaseous oxygen from the air separation process. As described earlier, the krypton and xenon concentrate in the oxygen. Therefore, in order to produce both gaseous oxygen product, and a further concentration of krypton and xenon, one must pass the entire amount of gaseous oxygen through the concentrating process. A typical concentrating process involves a stripping column. Since the entire gaseous oxygen product must be passed through the stripping column, the stripping column must be relatively large. Furthermore, the oxygen passing through the stripping column is subject to pressure drop which adds to the costly compression if the oxygen product is desired at elevated pressure. This is costly from both a capital and operating cost standpoint.

Therefore it would be very desirable to have a krypton-xenon concentration process which produces gaseous oxygen but can employ a stripping column significantly smaller than heretofore considered necessary for conventional processes.

It is therefore an object of this invention to provide an improved process to produce a krypton-xenon concentrate.

It is another object of this invention to provide an improved process to produce a krypton-xenon concentrate while also producing a gaseous oxygen product substantially free of rare gases.

It is still another object of this invention to provide an improved process to produce a krypton-xenon concentrate and a gaseous oxygen product while employing a stripping column significantly smaller than employed by conventional processes.

SUMMARY OF THE INVENTION

The above and other objects which will become apparent to one skilled in the art upon a reading of this disclosure are attained by:

A process for the production of a krypton-xenon concentrate and the recovery of a gaseous product substantially free of rare gases, comprising:

(1) providing a feed liquid comprising oxygen, krypton and xenon to a reboiling zone to form a reboiling liquid;

(2) partially vaporizing the reboiling liquid to produce a vapor, and a liquid krypton-xenon concentrate;

(3) recovering krypton-xenon concentrate;

(4) introducing into a stripping column, reflux liquid having a krypton-xenon concentration less than that in said vapor;

(5) passing said vapor against the reflux liquid downflowing in the stripping column;

(6) stripping krypton and xenon from the vapor into the reflux liquid to produce a lean vapor and a richer liquid;

(7) passing the richer liquid to the reboiling zone to form part of the reboiling liquid;

(8) withdrawing lean vapor from the stripping column; and (9) recovering withdrawn lean vapor as gaseous product substantially free of rare gases.

As used herein, the term "rare gas" means krypton and xenon.

As used herein, the terms "lean", "leaner", "rich" and "richer", refer to the concentration of rare gases, unless specifically indicated otherwise.

As used herein the term "reboiling zone" means a heat exchange zone where entering liquid is indirectly heated and thereby partially vaporized to produce gas and remaining liquid. The remaining liquid is thereby enriched in the less volatile components present in the entering liquid.

As used herein, the term "indirect heat exchange" means the bringing of two fluid streams into heat exchange relation without any physical contact or intermixing of the fluids with each other.

As used herein, the term "equilibrium stage" means a vapor-liquid contacting stage whereby the vapor and liquid leaving that stage are in mass transfer equilibrium. For a separation column that uses trays or plates, i.e. separate and discrete contacting stages for the liquid and gas phases, an equilibrium stage would correspond to a theoretical tray or plate. For a separation column that uses packing, i.e. continuous contacting of the liquid and gas phases, an equilibrium stage would correspond to that height of column packing equivalent to one theoretical plate. An actual contacting stage, i.e. trays, plates, or packing, would have a correspondence to an equilibrium stage dependent on its mass transfer efficiency.

As used herein, the term "column" means a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbood. Fifth Edition, edited by R. H. Perry and C. H. Chilton, McGraw-Hill Book Company, New York Section 13, "Distillation" B. D. Smith et al, page 13-3, *The Continuous Distillation Process.*

The term "double column" is used herein to mean a high pressure column having its upper end in heat exchange relation with the lower end of a low pressure column. An expanded discussion of double columns appears in Ruheman. "The Separation of Gases" Oxford University Press, 1949, Chapter VII, Commercial Air Separation, and Barron, "Cryogenic Systems", McGraw-Hill, Inc., 1966, p. 230, Air Separation Systems.

DETAILED DESCRIPTION

Figure 1:
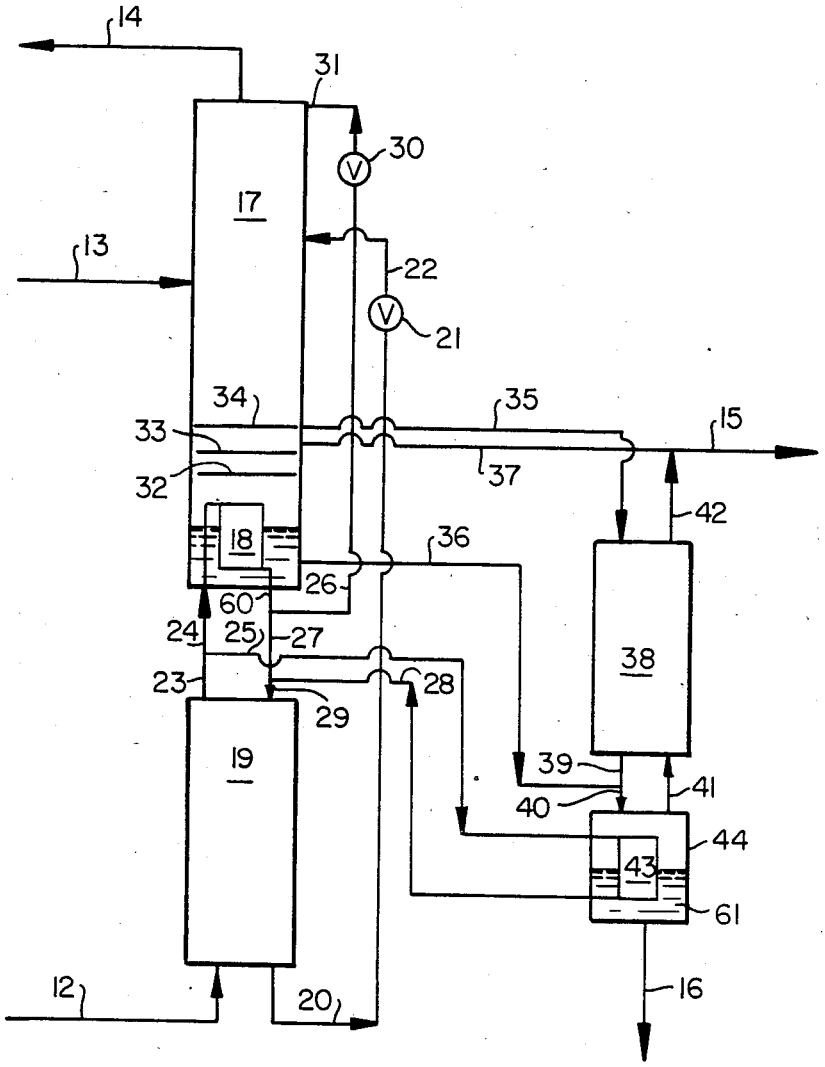
FIG. 1 is a schematic flow diagram of one preferred embodiment of the process of this invention. The schematic representation of FIG. 1 is particularly preferred in that it illustrates a case where the feed to the krypton-xenon concentration process comes from a double-column air separation plant and the feed is taken from the air separation plant so as to have an increased krypton-xenon concentration over that which would conventionally be attained in oxygen.

The process of this invention will be described in detail with reference to the drawing.

Referring now to FIG. 1, cooled pressurized feed air 12, which has been cleaned of high boiling impurities such as carbon dioxide and water vapor, is introduced into higher pressure column 19, operating at a pressure in the range of from 75 to 300 pounds per square inches absolute (psia), preferably from 75 to 150 psia. The cooling and cleaning steps, and other steps such as heat exchange with return streams, are not illustrated in FIG. 1 since such process steps are well-known conventional steps and do not form part of this invention.

Within higher pressure column 19, the feed air is preseparated into a nitrogen-rich vapor 23 and an oxygen-enriched liquid 20. Liquid 20 is expanded through valve 21 and introduced as feed 22 into lower pressure column 17 which is operating at a pressure in the range of from 15 to 100 psia, preferably from 15 to 30 psia.

Nitrogen-rich vapor 23 is passed 24 to condenser 18 wherein it is condensed by indirect heat exchange with reboiling liquid from the bottom of lower pressure column 17. The resulting condensed nitrogen-rich stream 60 is divided into stream 26 which is expanded through valve 30 and passed as stream 31 into column 17 as liquid reflux, and into stream 27 which is passed into column 19 as liquid reflux.

FIG. 1 also illustrates low pressure feed air stream 13 to column 17 which may be available from the warm end of the air separation process as obtained from development of plant refrigeration. Within column 17 the various input streams are separated by cryogenic rectification to produce nitrogen stream 14 and oxygen product. The nitrogen stream 14 may be recovered in whole or in part, or may be released to the atmosphere.

As indicated previously, virtually all of the krypton and xenon in the feed air will concentrate in the oxygen rather than in the nitrogen. FIG. 1 illustrates a particularly preferred embodiment wherein the krypton and xenon in the oxygen are further concentrated in a liquid oxygen portion enabling the recovery of a major portion of the oxygen as gaseous oxygen product, relatively free of rare gases, directly from column 17. This is accomplished by removing gaseous oxygen from column 17 as stream 37 above at least 1 and preferably at least 2 equilibrium stages or actual trays above the sump of column 17 wherein bottoms are reboiled against condensing nitrogen in condenser 18. In FIG. 1, tray 32 is the bottom tray, tray 33 is the next higher tray, and tray 34 is the third tray in this order. As can be seen oxygen product stream 37 in taken from between trays 33 and 34. In this way, because krypton and xenon both have lower vapor pressures than oxygen, the bulk of the krypton and xenon remains in liquid oxygen and is carried down into the sump, leaving stream 37 relatively free of rare gases.

As indicated, the major portion of the krypton and xenon in the feed air is contained in the liquid in the sump of column 17. This liquid is an ideal source of a feed to the krypton-xenon concentration process of this invention.

Referring again to FIG. 1, liquid stream 36 containing oxygen, krypton and xenon is provided to reboiling zone 44 to form reboiling liquid 61. Reboiling zone 44 may be separate from or may be within stripping column 38. The concentration of krypton and xenon in the feed liquid such as stream 36 may be any effective concentration, but, in general, the concentration of krypton will be at least 10 ppm and preferably at least 20 ppm, and the concentration of xenon will be at least 1 ppm, preferably at least 2 ppm, in the liquid feed stream.

In reboiling zone 44, the liquid 61 is partially vaporized to produce a vapor, which has a lower rare gas content than the remaining liquid. The vapor 41 is passed to stripping column 38 for upflow through the column. The remaining liquid with its relatively high krypton and xenon content is withdrawn as the liquid concentrate product 16 containing the rare gases. Typically the krypton concentration in concentrate 16 is at least 200 ppm and preferably is at least 400 ppm, and the xenon concentration in concentrate 16 is at least 15 ppm and preferably is at least 30 ppm.

FIG. 1 illustrates a particularly preferred embodiment wherein high pressure nitrogen-rich vapor from an associated double-column air separation plant is employed to carry out the partial vaporization in the reboiling zone. Referring to FIG. 1, a portion 25 of nitrogen-rich vapor 23 is passed to reboiler condenser 43 wherein it is condensed by indirect heat exchange with partially vaporizing reboiling liquid 61. The resulting condensed nitrogen stream 28 is passed to column 19 as liquid reflux. Conveniently, stream 28 may be combined with liquid nitrogen from main condenser 18 to form combined stream 29 for passage into column 19.

Stripping column 38 operates at a pressure within the range of from 15 to 100 psia, preferably from 15 to 30 psia, and serves to strip a significant portion, and preferably substantially all, of the krypton and xenon in vapor 41 into downflowing liquid. The entering downflowing stripping liquid must have a krypton-xenon concentration less than that of vapor 41 and preferably the krypton-xenon concentration in this reflux liquid when it enters the column is less than about 3 ppm. A convenient source for the reflux or stripping liquid is the double column air separation plant. FIG. 1 illustrates a particularly preferred embodiment wherein a liquid stream 35 is taken from above the point where gaseous oxygen product stream 37 is taken. In this way the liquid stream 35 has the low krypton-xenon concentration.

Within column 38 vapor 41 is passed against downflowing liquid 35 and krypton and xenon from vapor 41 are stripped into the downflowing liquid. The resulting richer liquid 39 is passed to reboiling zone 44 to form part of the reboiling liquid 61. FIG. 1 illustrates a convenient arrangement wherein richer liquid 39 is combined with feed liquid 36 to form liquid 40 and this combined liquid is passed to reboiling zone 44 to form reboiling liquid 61.

The lean vapor which results from the stripping operation is withdrawn from column 38 as stream 42 and recovered as gaseous product substantially free of rare gases. FIG. 1 illustrates a convenient arrangement wherein lean vapor 42 is combined with gaseous oxygen product 37 from the air separation process and the resulting combined stream 15 is recovered as gaseous oxygen product.

By passing the feed to the krypton-xenon concentration process directly to the reboiling zone rather than to the stripping column, and by carrying out the stripping process in the defined manner of this invention wherein only the vapor from the reboiling zone is passed through the stripping column, one is able to produce a krypton-xenon concentrate and a gaseous rare gas-free oxygen product employing a stripping column of considerably smaller size than is required for conventional krypton-xenon concentration processes. Typically for this process arrangement, the liquid feeds to the stripping column, i.e. streams 35 and 36, will be about 20 percent of the oxygen product 15 from the plant. Accordingly, the stripping column then handles vapor flow 42 which is about one-fifth that of the conventional rare gas recovery process and thereby requires about one-fifth the cross-sectional flow area of the conventional flow area of a conventional oxygen gas stripping column.

In the particularly preferred embodiment illustrated in FIG. 1, it can be seen that the greater part of the oxygen from the air separation plant bypasses the krypton-xenon process entirely thus reducing markedly the throughput and thus the size requirements of the stripping column. Generally the liquid stream to the reboiling zone contains from about 5 to 40 percent of the oxygen from the air separation plant, and preferably about 20 percent. Another advantage is that the majority of the oxygen gas 37 is maintained at the pressure level of low pressure column 17. The portion of the oxygen product 42 that must be processed in the stripping column can be returned at equivalent pressure by operating the stripping column at a slightly higher pressure level to compensate for the column pressure drops. The higher pressure level can be easily obtained by reducing the elevation of the stripping column and utilizing the hydrostatic liquid height for the two liquid feeds.

A further advantage of this process is that the liquid draw from the lower pressure column sump serves to avoid buildup of hydrocarbons in that column.

In Table I there are tabulated the results of a computer simulation of the process of this invention carried out in accord with the FIG. 1 embodiment. The data is presented for illustrative purposes and is not intended to be limiting. The abbreviation cfh means cubic feet per hour as measured at ambient temperature (70° F.) and atmospheric pressure (14.7 psia). The purity is defined in mole percent unless parts per million volume (ppm) is specified. The stream numbers correspond to those of FIG. 1.

TABLE I

| | Stream No. | | | | | | | |
|---|---|---|---|---|---|---|---|---|
| | 37 | 36 | 35 | 39 | 16 | 42 | 15 | 41 |
| Flow, cfh | 800 | 185 | 32 | 32 | 17 | 200 | 1000 | 200 |
| Temperature, °K. | 95 | 95 | 95 | 95 | 95 | 95 | 95 | 95 |
| Pressure, psia | 23 | 23 | 23 | 23 | 23 | 23 | 23 | 23 |
| Purity | | | | | | | | |
| Oxygen, % | 99.5 | 99.6 | 99.3 | 99.5 | 99.6 | 99.5 | 99.5 | 99.5 |
| Krypton, ppm | 0.3 | 39.1 | 2.5 | 339 | 427 | 1 | — | 55 |
| Xenon, ppm | — | 2.5 | — | — | 27 | — | — | 0.2 |
| Other, % | 0.5 | 0.4 | 0.7 | 0.5 | 0.4 | 0.4 | 0.5 | 0.5 |

As demonstrated by the data in Table I, the process of this invention effectively produces a krypton-xenon concentrate and substantially rare gas-free gaseous oxygen while requiring only a small flowrate for the feed to the concentration process. This significantly reduces both the capital and operating costs of the concentration process.

Although the process of this invention has been described in detail with reference to a particular embodiment, it can be appreciated that there are other embodiments of this invention within the spirit and scope of the claims.

I claim:

1. A process for the production of a krypton-xenon concentrate and the recovery of a gaseous product substantially free of rare gases, comprising:

(1) taking from an air separation plant a feed liquid comprising oxygen, krypton and xenon wherein the oxygen in the feed liquid comprises from about 5 to 40 percent of the oxygen from the air separation plant and providing said feed liquid to a reboiling zone to form a reboiling liquid;

(2) partially vaporizing the reboiling liquid to produce a vapor, and a liquid krypton-xenon concentrate;

(3) recovering krypton-xenon concentrate;

(4) introducing into a stripping column, reflux liquid having a krypton-xenon concentration less than that in said vapor;

(5) passing said vapor against the reflux liquid downflowing in the stripping column;

(6) stripping krypton and xenon from the vapor into the reflux liquid to produce a lean vapor and a richer liquid;

(7) passing the richer liquid to the reboiling zone to form part of the reboiling liquid;

(8) withdrawing lean vapor from the stripping column;

(9) recovering withdrawn lean vapor as gaseous product substantially free of rare gases; and

(10) recovering the major portion of the oxygen as oxygen gas product directly from the air separation plant, thereby enabling the employment of a stripping column of considerably smaller size then is required for conventional krypton-xenon concentration processes.

2. The process of claim 1 wherein the krypton concentration in the liquid feed is at least 10 ppm.

3. The process of claim 1 wherein the richer liquid from the stripping column is combined with feed liquid prior to passage to the reboiling zone.

4. The process of claim 1 wherein the stripping column operates at a pressure in the range of from 15 to 100 psia.

5. The process of claim 1 wherein the concentration of krypton in the krypton-xenon concentrate is at least 200 ppm.

6. The process of claim 1 wherein the feed liquid is taken from the area of heat exchange relation of a double column air separation process.

7. The process of claim 6 wherein the reflux liquid for the stripping column is provided from the lower pressure column of the double column process and is taken from a point above the point from where the feed liquid is taken.

8. The process of claim 7 wherein said reflux liquid is taken from the lower pressure column at least two equilibrium stages above the area of heat exchange relation.

9. The process of claim 6 wherein a gaseous stream is removed from the lower pressure column and recovered as product oxygen.

10. The process of claim 9 wherein the lean vapor is combined with said gaseous stream and the combined stream is recovered.

11. The process of claim 9 wherein the gaseous stream is removed from the lower pressure column at a point between the points from where the feed liquid and the reflux liquid are respectively taken.

12. The process of claim 6 wherein the partial vaporization of the reboiling liquid is carried out by indirect heat exchange with condensing nitrogen-rich vapor taken from the higher pressure column.

13. The process of claim 12 wherein the resulting condensed nitrogen-rich stream is returned to the higher pressure column as liquid reflux.

14. A process for the production of a krypton-xenon concentrate and the recovery of gaseous product substantially free of rare gases, comprising:

(1) providing feed air to a cryogenic rectification air separation plant comprising a higher pressure column and a lower pressure column in heat exchange relation;

(2) withdrawing a first liquid comprising oxygen, krypton and xenon from the area of heat exchange relation and providing said withdrawn liquid to a reboiling zone to form a reboiling liquid;

(3) partially vaporizing the reboiling liquid to produce a vapor, and a liquid krypton-xenon concentrate;

(4) recovering krypton-xenon concentrate;

(5) withdrawing a second liquid from the lower pressure column at a point above the point where the first liquid is withdrawn, said second liquid having a krypton-xenon concentration less than that in the vapor produced in the reboiling zone, and introducing said second liquid into a stripping column as reflux liquid;

(6) passing said vapor against the reflux liquid downflowing in the stripping column;

(7) stripping krypton and xenon from the vapor into the reflux liquid to produce a lean vapor and a richer liquid;

(8) passing the richer liquid to the reboiling zone to form part of the reboiling liquid;

(9) withdrawing lean vapor from the stripping column;

(10) recovering withdrawn lean vapor as gaseous product substantially free of rare gases;

(11) withdrawing from the lower pressure column, at a point between the points from where the first and second liquids are withdrawn, a gaseous stream; and

(12) recovering said gaseous stream as product oxygen.

15. The process of claim 14 wherein the withdrawn lean vapor and the withdrawn gaseous stream are combined and recovered together.

16. The process of claim 14 wherein the second liquid is withdrawn from the lower pressure column at least two equilibrium stages above the area of heat exchange relation.

17. The process of claim 14 wherein the partial vaporization of the reboiling liquid is carried out by indirect heat exchange with condensing nitrogen-rich vapor taken from the higher pressure column.

18. The process of claim 17 wherein the resulting condensed nitrogen-rich stream is returned to the higher pressure column as liquid reflux.

* * * * *